US007604466B2

(12) United States Patent
Dreiman et al.

(10) Patent No.: US 7,604,466 B2
(45) Date of Patent: Oct. 20, 2009

(54) DISCHARGE MUFFLER SYSTEM FOR A ROTARY COMPRESSOR

(75) Inventors: Nelik I Dreiman, Tipton, MI (US); John S Kosco, Tecumseh, MI (US); Robert J Reynolds, Morristown, TN (US)

(73) Assignee: Tecumseh Products Company, Ann Arbor, MI (US)

( * ) Notice: Subject to any disclaimer, the term of this patent is extended or adjusted under 35 U.S.C. 154(b) by 146 days.

(21) Appl. No.: 11/046,969

(22) Filed: Jan. 31, 2005

(65) Prior Publication Data

US 2006/0171835 A1 Aug. 3, 2006

(51) Int. Cl.
*F04C 18/00* (2006.01)

(52) U.S. Cl. ..... 418/63; 181/403

(58) Field of Classification Search ..... 181/403; 418/181; 417/312

See application file for complete search history.

(56) References Cited

U.S. PATENT DOCUMENTS

| | | | | |
|---|---|---|---|---|
| 3,526,942 | A | 9/1970 | Monden et al. | 29/156.4 |
| 3,850,551 | A | 11/1974 | Gamache et al. | 417/410 |
| 3,872,562 | A | 3/1975 | Pestel | 29/156.4 R |
| 3,874,187 | A | 4/1975 | Anderson | 62/230 |
| 4,058,361 | A | 11/1977 | Giurlando et al. | 417/312 |
| 4,601,644 | A * | 7/1986 | Gannaway | 417/363 |
| 4,730,996 | A | 3/1988 | Akatsuchi et al. | 418/15 |
| 4,743,177 | A | 5/1988 | Ozu et al. | 417/360 |
| 4,958,990 | A * | 9/1990 | Gordon et al. | 417/410.3 |
| 4,971,529 | A * | 11/1990 | Gannaway et al. | 417/313 |
| 5,022,146 | A * | 6/1991 | Gannaway et al. | 29/888.02 |
| 5,102,317 | A | 4/1992 | Okoma et al. | 418/60 |
| 5,288,211 | A * | 2/1994 | Fry | 417/312 |
| 5,605,447 | A * | 2/1997 | Kim et al. | 417/312 |
| 5,667,372 | A | 9/1997 | Hwang et al. | 418/63 |
| 6,102,682 | A * | 8/2000 | Kim | 418/63 |
| 6,155,805 | A * | 12/2000 | Fry | 417/415 |
| 6,176,687 | B1 * | 1/2001 | Kim et al. | 417/312 |
| 6,398,520 | B2 * | 6/2002 | Han | 417/312 |

FOREIGN PATENT DOCUMENTS

| | | |
|---|---|---|
| JP | 3-124991 | 5/1991 |

* cited by examiner

*Primary Examiner*—Thomas Denion
*Assistant Examiner*—Douglas J. Duff
(74) *Attorney, Agent, or Firm*—Baker & Daniels LLP

(57) ABSTRACT

An improved muffler system for a compressor assembly where the muffler is disposed within the compressor housing and a peripheral edge of the muffler abuts, and expansively engages, the interior surface of the housing in an interference fit relationship. The compressor pump is attached to the muffler where the pump is substantially thermally and vibrationally isolated from the housing. The muffler, the compressor pump and the compressor housing define a series of chambers in which noise generated by the compressor pump is dissipated. The dimensions of the chambers are chosen to cause acoustical waves having specific, undesirable frequencies to cancel each other out.

23 Claims, 5 Drawing Sheets

DISCHARGE MUFFLER SYSTEM FOR A ROTARY COMPRESSOR

BACKGROUND OF THE INVENTION

1. Field of the Invention

The present invention generally relates to compressors. More particularly, the present invention relates to a rotary compressor having an improved structure for mounting a compressor pump within a compressor housing.

2. Description of the Related Art

Existing compressors typically include a housing, an electric motor and a compressor pump mounted to the housing, and a shaft rotatably engaged with the electric motor and the compressor pump. The electric motor is commonly powered by an external power source which energizes the stator windings of the motor to turn the motor shaft. In rotary compressors, the shaft drives an eccentric mechanism in the compressor pump to draw, compress and expel a working fluid through a discharge port.

In existing compressors, various methods of mounting a compressor pump within a compressor housing exist. In a rotary compressor such as described in U.S. Pat. No. 4,601,644, a bearing portion of the compressor pump is supported by the compressor housing at several points. The cylindrical compressor housing has holes through its circumference to receive attachment lugs extending from the bearing portion. The attachment lugs extend through the housing holes such that they can be welded directly to the housing from the outside. However, welding the bearing lugs to the housing in this manner may allow debris from the welding process to enter the housing which can damage the compressor. Disadvantageously, these compressors are conducive to leaking through these holes and creating these holes requires additional time and equipment, thereby increasing the cost of the compressor assembly. Additionally, considerable time and effort is expended to align the weld tabs with the housing.

In compressors where the bearing portion or cylinder block of the compressor pump are held in compression against the housing, distortion can occur in the bearing or cylinder block when they are welded to the housing. As the bearing portion or cylinder block, which are commonly made of cast iron or other ductile ferrous materials, are heated during the welding process, the heat is conducted to the shaft support aperture in the bearing portion or the compression chamber of the cylinder block. When exposed to heat, the shaft support aperture and the compression chamber may distort due to stress relaxation of the cast iron, or they may be distorted when they are restricted from expanding due to the compressive spring force of the housing. When restricted, stress may build in the bearing or cylinder block material causing it to permanently deform or yield. Even a small amount of permanent deformation is undesirable as the dimensional tolerances necessary for the proper operation of the rotary compressor are extremely close and are generally on the order of ten thousandth of an inch.

Another disadvantage of using the bearing portion or cylinder block to mount the compressor pump to the housing includes increasing the size of these components to bring a weldable surface in close proximity to the housing. Increasing the size of these members adds weight and cost to the compressor.

What is needed is an improvement over the foregoing.

SUMMARY OF THE INVENTION

The present invention overcomes the disadvantages of the above described prior art compressors by providing a discharge muffler which improves the mounting of the compressor pump to the compressor housing.

In one form of the invention, a muffler is installed within a compressor housing where the peripheral edge of the muffler abuts, and expansively engages, the interior surface of the housing in an interference fit relationship. The muffler is compressed by the resilient spring force of the expanded housing where the muffler and the housing can be fastened together through a laser-welding process, for example. During a laser-welding process, an intense laser beam is directed against the exterior of the housing where the contacting surfaces of the muffler and the housing are heated. Subsequently, the heated surfaces are allowed to cool and the muffler and the housing become fused together. This design is an improvement over the aforementioned compressors as holes are not needed in the compressor housing to complete the weld. The muffler may be oriented in many alternative positions and can be welded to the housing in substantially any location along the periphery of the muffler.

The muffler dampens vibrations emanating from the pump and isolates the compressor bearing and cylinder block from the heat conducted from the welded surface. Additionally, the muffler, in co-operation with the housing and the bearing portion, define chambers that act as resonators to reduce the noise created by the compressor pump. The chambers are designed to reflect the sound waves produced by the compressor pump in such a way that the sound waves partially cancel themselves out.

In one form of the invention, the muffler is disposed within the compressor housing where the muffler has a peripheral edge affixed to the housing and the bearing portion of the compressor pump is attached to the muffler. The muffler, compressor pump bearing portion and compressor housing define a series of chambers in which noise generated by the compressor pump is dissipated. A first chamber is intermediate the bearing portion and the muffler where gas exhausted through an exhaust port in the bearing portion enters the first chamber. Noise generated by the pump is carried by the exhaust gas into the first chamber, however, the noise is dissipated, or dampened, when the gas strikes the muffler and the other surfaces comprising the first chamber. The noise is further dissipated by the first chamber as it acts as a resonator where the dimensions of the first chamber are chosen to cause acoustical waves having specific, undesirable frequencies to cancel each other out.

In one form of the invention, the muffler may have at least one aperture through which the exhaust gas can escape into a second chamber in the compressor. The second chamber is defined by one side of the muffler and the compressor housing. Exhaust gas entering the second chamber may exit the compressor through a discharge pipe or enter a third chamber defined by the opposite side of the muffler and the compressor housing. The second chamber and the third chamber are in fluid communication through at least one gap intermediate the muffler and the housing. Similar to the above, the sound waves created by the compressor are somewhat dissipated when they strike the surfaces defining the second and third chambers. Also, the second and third chambers acts as resonators where sound waves carried by the discharge gas are dissipated by passing between the second chamber and the third chamber through the gap. In other embodiments, the muffler may have at least one second aperture fluidly connecting the second and third chambers. The second apertures may also assist in the dissipation of sound waves conducted by the exhaust gas. Further, the gap between the housing and the muffler and the second aperture permit oil carried by the exhaust gas to return to the oil sump in the bottom of the compressor.

In this embodiment, the muffler is also a mounting plate, thus simplifying the design and the assembly process of the compressor as described herein.

BRIEF DESCRIPTION OF THE DRAWINGS

The above-mentioned and other features and advantages of this invention, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE DRAWINGS

Figure 1:
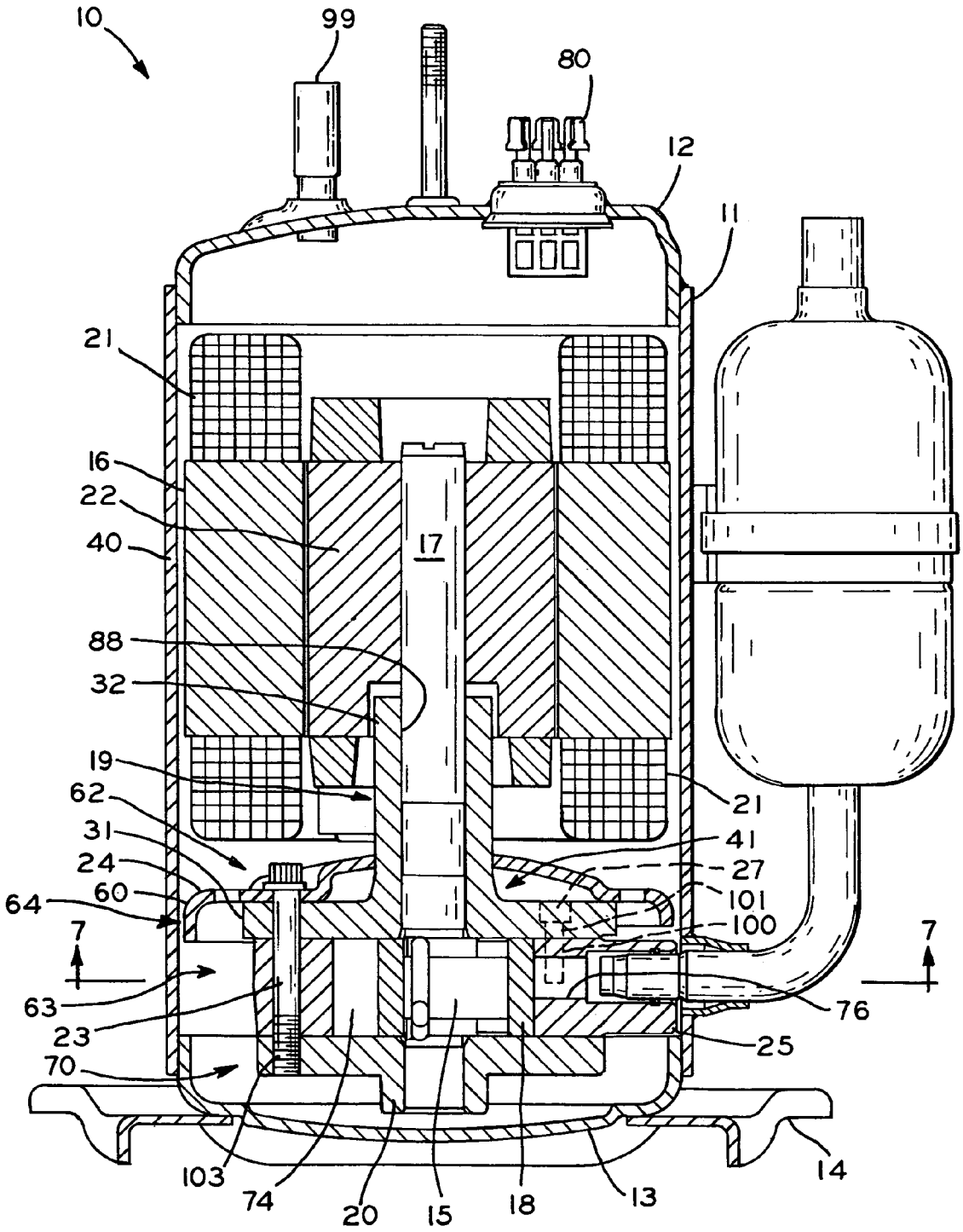
FIG. 1 is a sectional elevation view of a compressor in accordance with an embodiment of the present invention.
Figure 7:
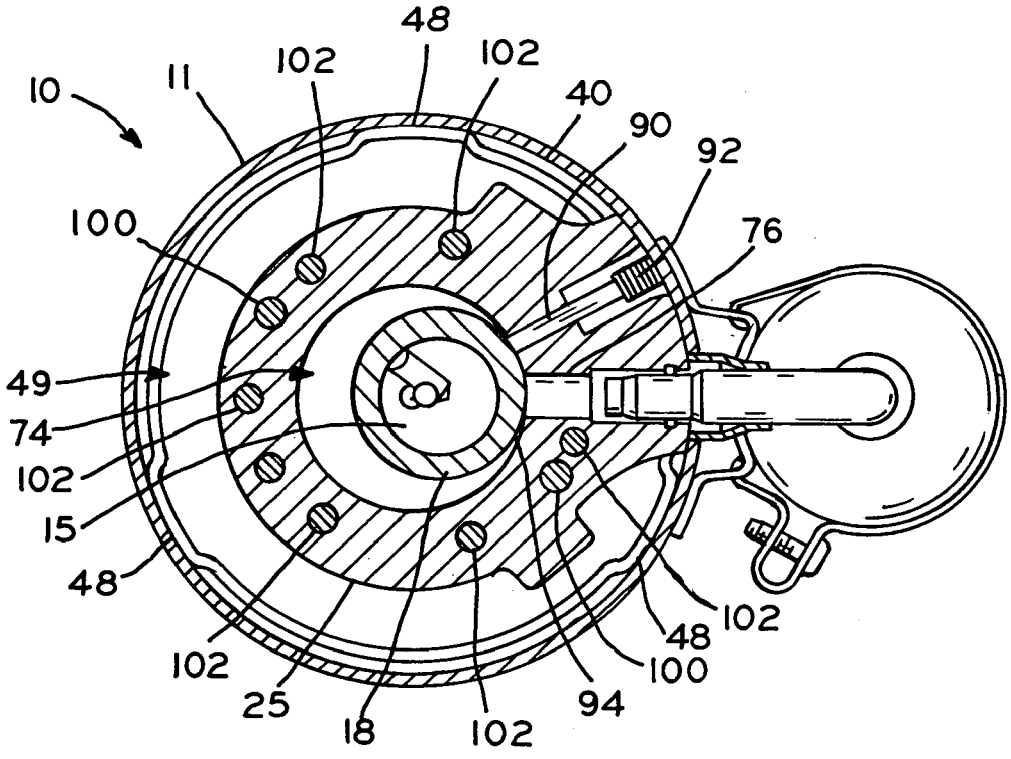
FIG. 7 is a sectional view of the compressor assembly in FIG. 1.

Referring now to the drawings and in particular to FIGS. 1 and 7, a compressor 10 is shown which comprises a generally cylindrical hermetic housing 11 having welded thereto upper end cap 12, lower end cap 13, and external mounting flange or bracket 14 having a plurality of mounting feet. An electric motor is positioned within housing 11 and includes crankshaft 17, having rotor 22 press fit thereon, which is rotatably driven when windings 21 of stator 16 are energized by an outside energy source. The outside electric source is operatively connected to compressor 10 through electrical connector 80. However, compressor 10 may be powered from an internal or integral energy source. Electric motor stator 16 is press fit into housing 11 and is substantially cylindrical, however, it has flats between its rounded portions which provide passageways between stator 16 and housing 11 which facilitate the flow of lubricant and compressed fluid therebetween.

Crankshaft 17 is also drivingly engaged with the compressor pump. The compressor pump includes main bearing portion 19 (FIGS. 2A and 2B), cylinder block 25, outboard bearing portion 20, and roller 18 mounted to crankshaft 17 (FIGS. 1 and 7). Six fasteners 23 join bearing portions 19 and 20 and cylinder block 25 together. These components, along with roller 18, create compression chamber 74 (FIGS. 1 and 7) when assembled. Roller 18 is rotated within compression chamber 74 to compress gas between the outer diameter of roller 18 and the inner diameter of cylinder block 25.

The interior of cylinder block 25, at any given time during the operation of the compressor, is divided into a suction chamber and a discharge chamber. The suction and discharge chambers are divided from each other by vane 90 (FIG. 7) which is biased against roller 18 by spring 92 (FIG. 7) and high point 94 of roller 18 which is positioned proximal to the interior of cylinder block 25. As roller 18 is rotated, gas is drawn into the suction chamber through suction port 76 (FIGS. 1 and 7). The size of the suction chamber increases as high point 94 of roller 18 is rotated toward vane 90. Correspondingly, the size of the compression chamber decreases as roller 18 is rotated toward vane 90. The refrigerant trapped between high point 94 and vane 90 is compressed by roller 18 until the refrigerant is discharged through discharge port 30 (FIG. 2A), which is an orifice in main bearing 19 and is in fluid communication with compression chamber 74. Once high point 94 passes suction port 76, a new quantity of refrigerant is trapped between high point 94 and vane 90 and the cycle is repeated.

Figure 2A:
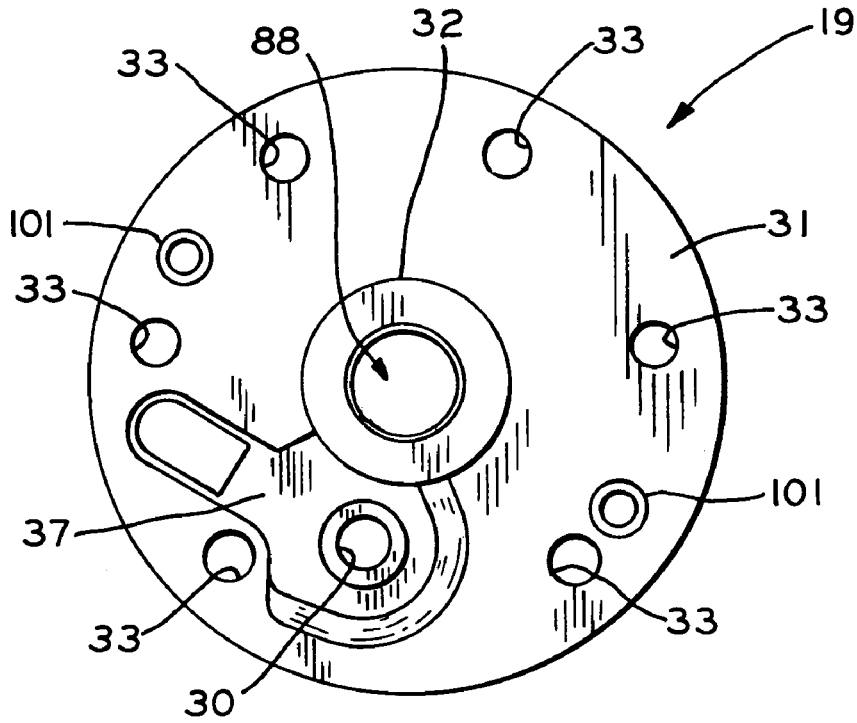
FIG. 2A is a plan view of the compressor mechanism bearing portion.
Figure 2B:
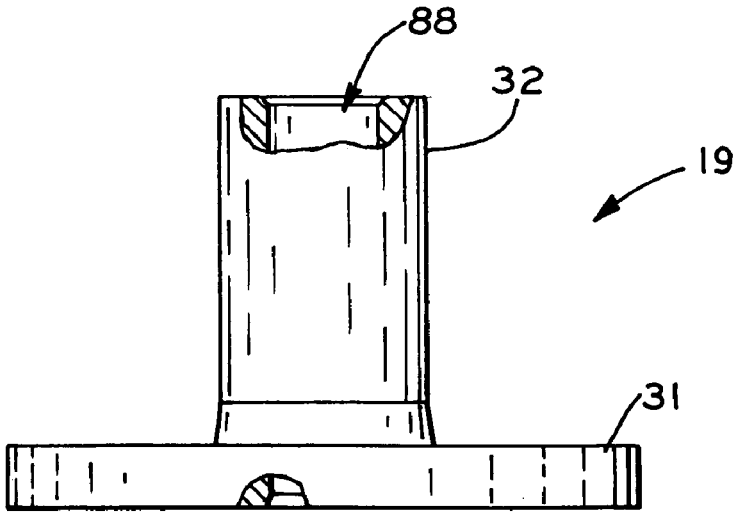
FIG. 2B is a partial sectional elevation view of the bearing portion in FIG. 2A.

As shown in FIGS. 2A and 2B, main bearing 19 has circularly shaped planar portion 31 and cylindrical portion 32. Cylindrical portion 32 rotatably supports crankshaft 17. Planar portion 31 has six holes 33 located therein to permit assembly of bearing 19 to cylinder block 25 by using bolts 23 which extend through holes 33. Bolts 23 also secure discharge muffler 24 (FIG. 1) to main bearing 19 above planar portion 31 and are threaded into outboard bearing 20 as shown in FIG. 1. A discharge valve assembly (not shown) is attached to planar portion 31 in cavity 37 to regulate the gas exiting through discharge port 30. Discharge port 30 in main bearing 19 allows compressed refrigerant to be discharged from compression chamber 74 into first chamber 41 (FIG. 1), where first chamber 41 is defined by planar portion 31 and discharge muffler 24.

Figure 3A:
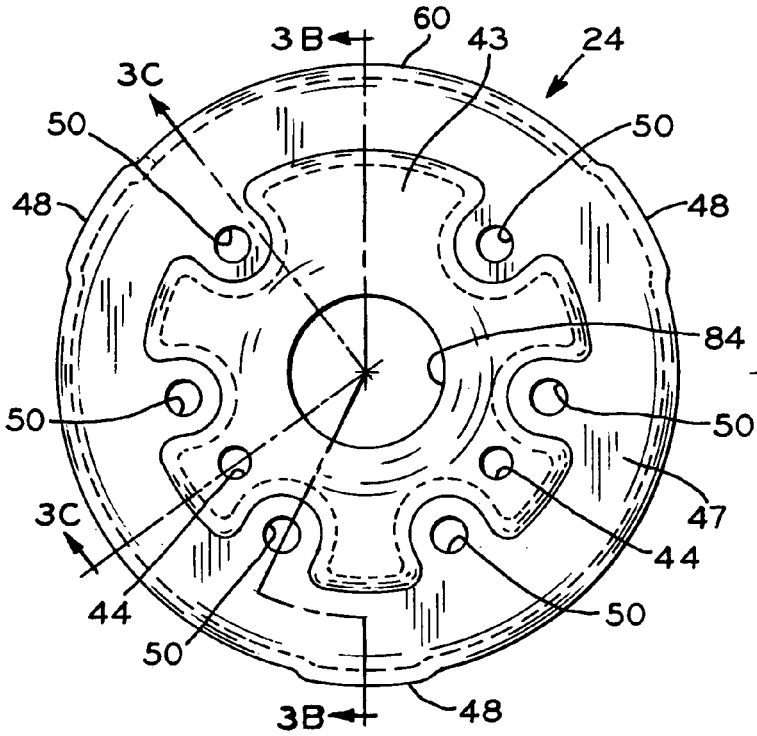
FIG. 3A is a plan view of the muffler.
Figure 3B:
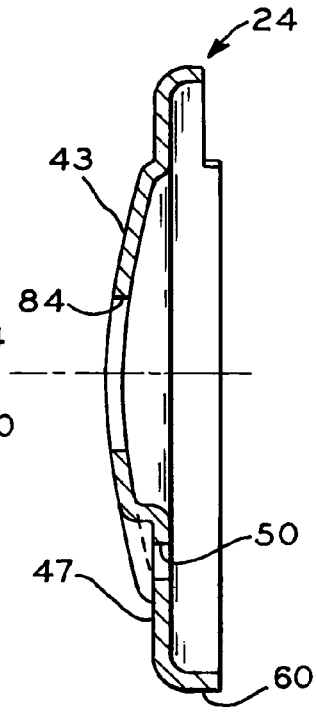
FIG. 3B is a sectional view of the muffler in FIG. 3A.
Figure 3C:
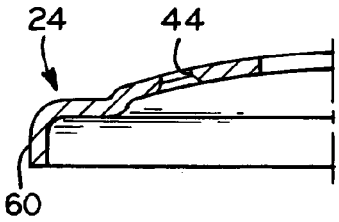
FIG. 3C is a sectional view of the muffler in FIG. 3A.

Referring to FIGS. 3A-3C, discharge muffler 24 includes a housing portion having flat portion 47, raised portion 43 and annular ring 60. Apertures 50 are provided in flat portion 47 through which fasteners 23 extend to fasten the discharge muffler 24 to the compressor pump as described above. Flat portion 47 also includes aperture 84 which engages cylindrical portion 32 of bearing portion 19 such that muffler 24 and bearing portion 19 are substantially sealed together. Aperture 84 of muffler 24 may engage cylindrical portion 32 in a slip-fit manner. Raised portion 43 is provided with output holes 44 which allow compressed refrigerant in first chamber 41 to exit chamber 41 through muffler 24 into second chamber 62 (FIG. 1), where chamber 62 is defined by the interior of housing 11 and muffler 24. The other side of flat portion 47, with housing 11, defines third chamber 63 (FIG. 1). Chambers 62 and 63 are in fluid communication through slots 64 (FIG. 1) between inner wall 40 of housing 11 and ring 60 of muffler 24. Slots 64 are necessary for the return of circulated oil to oil sump 70 (FIG. 1) located at the bottom of the compressor.

Slots 64 are also used to connect chambers 62 and 63 to create a system of Helmholtz resonators to dissipate noise, or sound waves, created by the compressor pump. These sound waves, which propagate through the circulating steam in the compressor, typically cause an undesirably high level of audible noise to emanate from the compressor. Some of the sound waves are dissipated by muffler 24 and first chamber 41, however, additional chambers can be used to absorb residual acoustic energy propagating in the compressor and to reduce housing space resonance. To accomplish this, slots 64 and chambers 62 and 63 are configured such that the sound waves passing between these chambers can cancel each other out. Sound waves cancel each other out when they occupy the same space and their frequencies are out of phase with each other, preferably 180 degrees out of phase. This can be accomplished by designing the thickness of muffler 24, the cross-section of gap 64, and the depth of cavities 62 and 63 such that sound waves entering third chamber 62 through slots 64 and are destructively interfered with by sound waves reflecting back through slots 64.

Slots 64 and chambers 62 and 63 are configured to cancel out a specific, but limited, range of frequencies. In another way, slots 64 and chambers 62 and 63 are designed such that the natural frequency of the Helmholtz system matches the targeted frequency of the sound waves that are desired to be cancelled out. As the sound waves emanating from the compressor pump are a mixture of many different frequencies and depend on the speed of crankshaft 47, the Helmholtz system should be designed to filter out the frequency range most likely to occur during the steady state, or normal, operation speed of the compressor. Even though the range of frequencies produced during steady state operation may be greater than the range of frequencies that can be cancelled out, the system of Helmholtz resonators discussed above will still produce some destructive interference of the sound waves thereby reducing the sound emanating from the compressor.

Similar to the above, the size of first chamber 41 and the configuration, location and quantity of discharge ports 44 may be tuned to accomplish a similar result.

Figure 4:
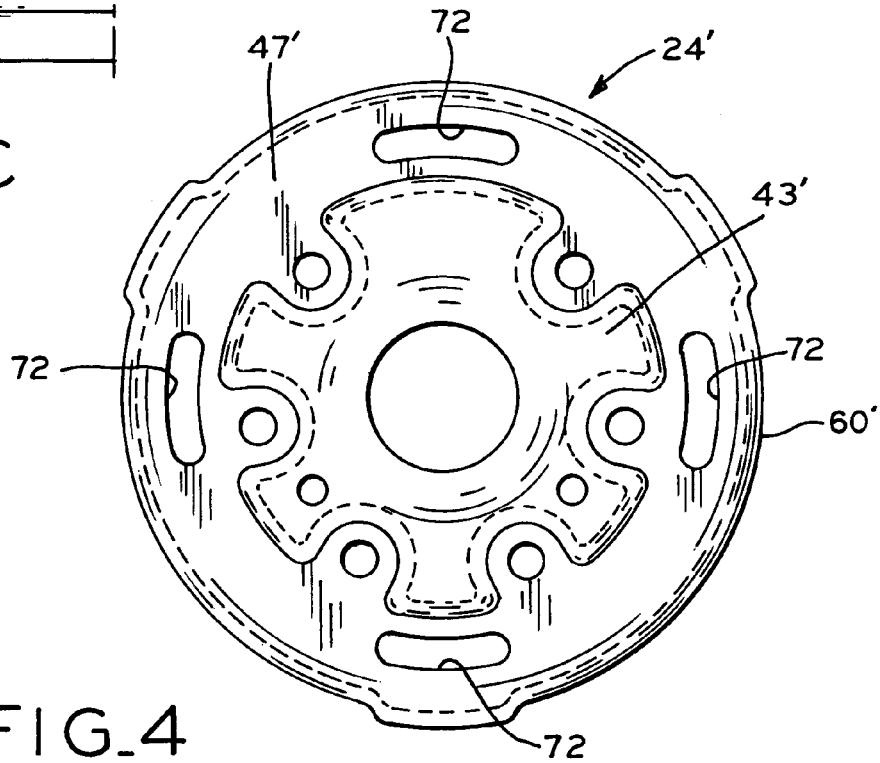
FIG. 4 is a plan view of an alternative muffler in accordance with an embodiment of the present invention.

In yet another embodiment (see FIG. 4), muffler 24' is provided with optional slots 72 which can increase the oil return rate to sump 70 and also improve the absorption of the acoustic energy. The geometry, location and quantity of slots 72 can be designed to be consistent with the natural frequency of the system, or they can be used to alter it. Similar to the above, the natural frequency of the system will depend on the geometrical configuration of slots 72 and the thickness of muffler 24'.

Once the compressed gas enters second chamber 62, it is also free to pass through discharge port 99 (FIG. 1) in the top of compressor 10 where the gas can continue through the refrigeration system.

To support muffler 24 within housing 11, radially and circumferentially extending part 47 of muffler 24 has a plurality of tabs 48 (FIG. 3A) provided on annular ring 60 for mounting the pump-muffler assembly 49 (FIG. 7) to inner surface 40 of housing 11. Discharge muffler 24 is held in compression against inner wall surface 40 of housing 11 so that the housing wall acts as a compression spring to substantially center assembly 49 in housing 11. By centering assembly 49, including shaft aperture 88 (FIG. 2A), within housing 11, crankshaft 17, which extends from the compressor pump, is substantially aligned with the center of stator 16 as stator 16 is also press-fit into and centered by housing 11. This alignment is important as, when crankshaft 17 is rotated by the electromagnetic force produced by stator 16, any misalignment between the center of stator 16 and shaft aperture 88 in bearing portion 19 will cause shaft aperture 88 to wear prematurely or cause dysfunction in the compression process.

The preferred method of assembling compressor 10 is to first press-fit stator 16 into housing 11, as discussed above. Subsequently, roller 18 is assembled to eccentric journal 15 of shaft 17. Eccentric journal 15 can be integral to shaft 17 or affixed to shaft 17 by compression fit. Shaft 17 is then passed through shaft aperture 88 of upper bearing 19. Brass journals (not shown) may be inserted between shaft 17 and aperture 88 to improve the longevity of bearing 19. Subsequently, cylinder block 25 is positioned against upper bearing 19 such that eccentric journal 15 and roller 18 are positioned within compression chamber 74. Cylinder block 25 is then aligned with respect to roller 18 such that a 0.0005"-0.0007" clearance exists between the outer diameter of roller 18 and the inner diameter of cylinder block 25 at a locating or set point. This set point is located 105±5 degrees counter-clockwise, as viewed from the open end of the cylinder block, from the top dead center position of roller 18 within compression chamber 74. The top dead center position of roller 18 is the position in which high point 94 passes discharge port 30 in upper bearing 19.

Subsequently, upper bearing 19 is fastened to cylinder block 25 by locator bolts 27 (FIG. 1) passing through locator bolt holes 101 of bearing 19 and holes 100 of cylinder block 25. Threaded bolt holes 100 receive the threaded end of these bolts so that bearing 19 and block 25 can be fastened together such that they cannot substantially move with respect to one another. Subsequently, vane 90 and spring 92 are inserted into cylinder block 25. Muffler 24 is then positioned over upper bearing 19 and outboard bearing 20 is placed against the opposite side of cylinder block 25. Bolts 23 are passed through bolt holes 50 in muffler 24 (FIG. 3A), bolt holes 33 in upper bearing 19 (FIG. 2A), bolt holes 102 in cylinder block 25 (FIG. 7) and bolt holes 103 in outboard bearing 20 (FIG. 1). The threaded ends of bolts 23 threadingly engage holes 103 of outboard bearing 20 so that muffler 24, bearing 19, block 25 and bearing 20 can be tightened together to comprise subassembly 49 (FIG. 7). Subsequently, locator bolts 27 can be removed. Subassembly 49 is then inserted into housing 11 where muffler 24 makes contact with housing 11 and shaft 17 is substantially concentrically aligned with the center of stator 16. End caps 12 and 13 are then welded to housing 11 to hermetically seal compressor assembly 10.

Figure 5A:
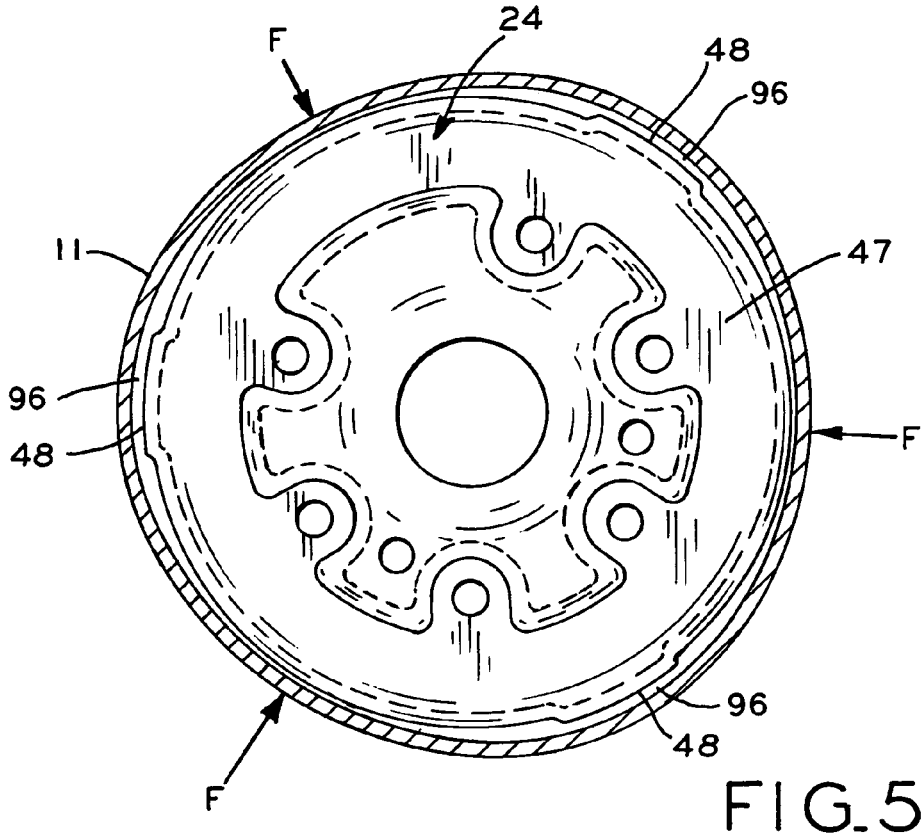
FIG. 5A is a partial sectional plan view of the compressor assembly illustrating a step in the assembly process of the compressor assembly.
Figure 5B:
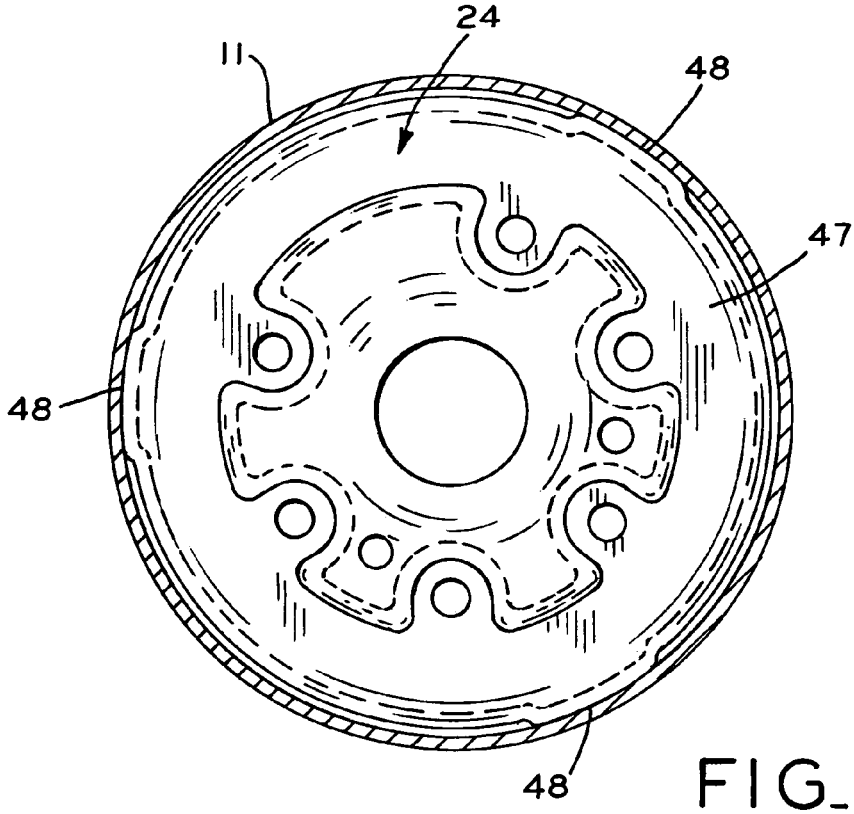
FIG. 5B is a partial sectional plan view illustrating a subsequent step in the assembly process of the compressor assembly.

During the assembly of the compressor, it may be necessary to temporarily distort housing 11 in the radial direction to insert muffler 24. As illustrated in FIG. 5A, housing 11 can be compressed at three locations around its circumference such that, at other locations, gaps are created, as illustrated by gaps 96, between tabs 48 and housing 11. Gaps 96 allow muffler 24 to be easily positioned in housing 11. Once muffler 24 is positioned in housing 11, housing 11 can be released to spring back to its original state, as illustrated in FIG. 5B. Discharge muffler 24 is held in compression by housing 11, which acts as a spring to allow for substantial variation in the interference fit between tabs 48 and housing 11. Other processes for inserting muffler 24 into housing 11 can be used. For example, a mandrel can be inserted into housing 11 to resiliently expand its entire circumference. Alternatively, housing 11 can be heated such that it resiliently expands due to thermal expansion. In this process, muffler 24 is inserted into housing 11 after it has been heated. Subsequently, housing 11 is allowed to cool and contract around muffler 24.

Discharge muffler 24 can be stamped from cold formed steel, the same metal preferred for housing 11, or any other metal with good weldability properties to allow reliable weld joining of tabs 48 and inner surface 40 of housing 11. One of the problems with the prior art is that the material properties of the cylinder block and bearing portion are frequently dissimilar to the housing material properties. The housings of most existing compressors are made from cold rolled steel while the bearing portion and the cylinder block are commonly made from cast iron or powdered metal. Welding dissimilar metals together, such as cast iron and cold formed steel, is difficult as these materials melt at different temperatures. Thus, one metal must continue to be heated until the other material has become sufficiently heated to weld them together. Further, having materials with different expansion rates may increase the gap between tabs 48 and housing 11 during welding causing an inconsistently thick weld. Having welds with an inconsistent thickness may cause voids or other non-homogeneous anomalies to occur during the welding process creating weak points. Additionally, having materials with different expansion rates may allow residual stresses to build in the bearing and cylinder blocks when they are cooling. Residual stress in brittle materials, such as powdered metal or cast iron, may cause the materials to crack when placed under the load of an operating compressor.

In addition to the above, another problem in the prior art is that powdered metal or cast iron compressor parts are not always as easy to weld. Common welding processes, which are sensitive to variables such as porosity and the presence of impurities in the welded materials, are often inefficient or ineffective when applied to cast iron or powdered metal which commonly have significant porosity. Excessive porosity, due to foreign particle melting or filler weld infiltration, can result in excessive shrinkage or growth of the material during welding with the potential for subsequent cracking to occur in or near the weld interface. Pores also act as thermal insulators which slow the transfer of heat, making the powdered metal components less hardenable and increase the material susceptibility to cracking. The present embodiments are an improvement over the foregoing as both housing 11 and muffler 24 can be made from the same material, preferably cold-formed steel which has excellent weldability properties.

In the embodiment shown, housing 11 does not have holes to directly weld tabs 48 to housing 11 from the outside. However, tabs 48 may be welded to housing 11 through a laser welding process. The use of the laser welding process to attach plate muffler 24 to housing 11 provides several advantages including reducing the heat applied during the welding process, which results in minimal shrinkage and distortion of the welded housing and discharge muffler. Further, laser welding is a much cleaner and much faster process than traditional arc welding. Generally no flux or filler material is required. Laser welding occurs in open air as opposed to MIG welding which requires a protective gas, such as argon. Further, there is no contact between the welding equipment and the work parts which simplifies fixturing. Additionally, laser welding produces high-strength consistent, repeatable welds, with a narrow weld bead and a generally good appearance. The strength of the weld can be improved by increasing the length or size of the weld joint. In order to accommodate a larger weld, the size of tabs 48 can be increased, which is commonly required for larger capacity compressors.

Figure 6:
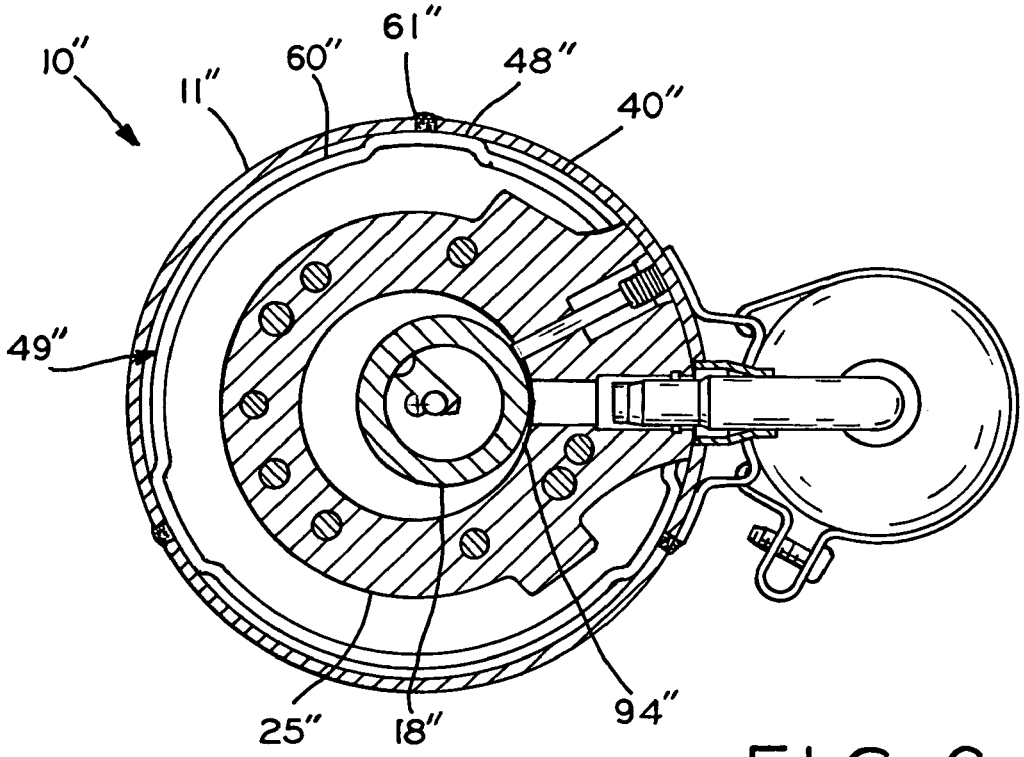
FIG. 6 is a sectional view of the compressor assembly illustrating an alternative method of construction.

However, some embodiments do not exclude the possibility of using conventional MIG welding process (see FIG. 6). Conventional MIG welding does not require excessive attention to tolerances and tedious alignment during assembly to assure precise location of the muffler against holes 61" (see FIG. 6) in the housing. By welding housing 11" directly to muffler 24", the tolerances and concentricity of such essential pump parts as main bearing 19", cylinder block 25", and outboard bearing 20" are not affected by spring forces of the housing or distortion forces of the welding process.

While this invention has been described as having exemplary embodiments, the present invention can be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor assembly, comprising:

a compressor housing having an interior surface defining an interior housing volume; a motor disposed within said housing volume, said motor having a rotatable shaft;

a compressor mechanism drivingly connected to said shaft, said compressor mechanism disposed within said housing volume and including a cylinder block having a peripheral surface adjacent the housing interior surface and a main bearing together with the cylinder block forming a compression chamber, said bearing rotatably supporting said shaft, said cylinder block peripheral surface not being directly fixed to the housing interior surface;

a muffler disposed within said housing volume, said muffler including a housing portion having a peripheral edge abutting the interior surface of said compressor housing in an interference fit relationship, said muffler being supported by said compressor housing, said compressor mechanism main bearing attached to said muffler and supported by said muffler within said compressor housing, said muffler housing portion facing and forming with said main bearing portion a first muffler chamber configured to dissipate acoustic waves, at least one opening in said muffler housing portion fluidly connecting said first chamber with said housing volume; and a discharge port in said main bearing extending from said compression chamber and opening into said first muffler chamber;

wherein said muffler and said interior surface of said compressor housing define a second chamber and a third chamber, said first chamber and said second chamber in fluid communication through at least one discharge passage, said first chamber, said second chamber and said at least one discharge passage configured to dissipate acoustic waves produced by said compressor mechanism.

2. The compressor assembly of claim 1, said first chamber, said second chamber and said at least one discharge passage tuned to dissipate acoustic waves having a specific frequency.

3. The compressor assembly of claim 1, including at least one gap intermediate said muffler housing portion and said interior of said compressor housing, said second chamber and said third chamber in fluid communication through said at least one gap, said second chamber, said third chamber and said at least one gap configured to dissipate acoustic waves produced by said compressor mechanism.

4. The compressor assembly of claim 3, said second chamber, said third chamber and said at least one gap tuned to dissipate acoustic waves having a specific frequency.

5. A compressor assembly, comprising:

a compressor housing having an interior surface defining an interior housing volume; a motor disposed within said housing volume, said motor having a rotatable shaft;

a compressor mechanism drivingly connected to said shaft, said compressor mechanism disposed within said housing volume and including a cylinder block and a main bearing together forming a compression chamber, said bearing rotatably supporting said shaft;

a muffler disposed within said housing volume, said muffler including a housing portion having a peripheral edge abutting the interior surface of said compressor housing in an interference fit relationship, said muffler being supported by said compressor housing, said compressor mechanism main bearing attached to said muffler and supported by said muffler within said compressor housing, said muffler housing portion facing and forming with said main bearing portion a first muffler chamber configured to dissipate acoustic waves, at least one opening in said muffler housing portion fluidly connecting said first chamber with said housing volume; and a discharge port in said main bearing extending from said compression chamber and opening into said first muffler chamber;

said peripheral edge of said muffler housing portion defined by at least three protrusions extending from said muffler housing portion, said at least three protrusions abutting the interior of said compressor housing to resiliently expand said compressor housing, at least one gap between the muffler housing portion and the compressor housing interior being positioned intermediate the three protrusions.

6. The compressor assembly of claim 1, wherein said muffler includes at least one oil return aperture, said second chamber and said third chamber in fluid communication through said at least one oil return aperture, said second chamber, said third chamber and said at least one oil return aperture configured to dissipate acoustic waves produced by said compressor mechanism.

7. The compressor assembly of claim 6, said second chamber, said third chamber and said at least one oil return aperture tuned to dissipate acoustic waves having a specific frequency.

8. A compressor assembly, comprising:

a compressor housing having an interior surface defining an interior housing volume; a motor disposed within said housing volume, said motor having a rotatable shaft;

a compressor mechanism drivingly connected to said shaft, said compressor mechanism disposed within said housing volume and including a cylinder block and a main bearing together forming a compression chamber, said bearing rotatably supporting said shaft;

a muffler disposed within said housing volume, said muffler including a housing portion having a peripheral edge abutting the interior surface of said compressor housing in an interference fit relationship, said muffler being supported by said compressor housing, said compressor mechanism main bearing attached to said muffler and supported by said muffler within said compressor housing, said muffler housing portion facing and forming with said main bearing portion a first muffler chamber configured to dissipate acoustic waves, at least one opening in said muffler housing portion fluidly connecting said first chamber with said housing volume; and a discharge port in said main bearing extending from said compression chamber and opening into said first muffler chamber;

said motor in an interference fit relationship with said compressor housing, said compressor mechanism and said motor aligned by said compressor housing and said muffler housing portion, said shaft operatively aligned with said compressor mechanism and said motor.

9. The compressor assembly of claim 8, said muffler housing portion including a bearing alignment aperture, said bearing including a cylindrical portion, said cylindrical portion extending through said bearing alignment aperture, said cylindrical portion including a shaft aperture, said shaft rotatably supported in said shaft aperture.

10. The compressor assembly of claim 9, wherein said bearing alignment aperture of said muffler engages said cylindrical portion of said bearing in an interference fit manner.

11. A compressor assembly, comprising:

a compressor housing having an interior surface defining an interior housing volume; a motor disposed within said housing volume, said motor having a rotatable shaft;

a compressor mechanism drivingly connected to said shaft, said compressor mechanism disposed within said housing volume and including a cylinder block and a main bearing together forming a compression chamber, said bearing rotatably supporting said shaft;

a muffler disposed within said housing volume, said muffler including a housing portion having a peripheral edge abutting the interior surface of said compressor housing in an interference fit relationship, said muffler being supported by said compressor housing, said compressor mechanism main bearing attached to said muffler and supported by said muffler within said compressor housing, said muffler housing portion facing and forming with said main bearing portion a first muffler chamber configured to dissipate acoustic waves, at least one opening in said muffler housing portion fluidly connecting said first chamber with said housing volume; and a discharge port in said main bearing extending from said compression chamber and opening into said first muffler chamber;

wherein said cylinder block has an outer circumferential periphery that is spaced radially from the housing interior surface along its entire periphery and said periphery is not fixed to said housing interior surface.

12. A compressor assembly, comprising:

a compressor housing having an interior surface; a motor disposed within said housing, said motor having a rotatable shaft;

a compressor mechanism drivingly connected to said shaft, said compressor mechanism disposed within said housing and including a cylinder block and a main bearing together forming a compression chamber, said bearing rotatably supporting said shaft;

a muffler disposed within said housing, said muffler including a housing portion having a peripheral edge abutting and connected to the interior surface of said compressor housing, said muffler being supported by said compressor housing, said compressor mechanism main bearing attached to said muffler and supported by said muffler within said compressor housing whereby said cylinder block is also supported by said muffler, said muffler housing portion facing and forming with said main bearing a first muffler chamber configured to dissipate acoustic waves; and a discharge port in said main bearing extending from said compression chamber and opening into said first muffler chamber;

wherein said cylinder block has an outer circumferential periphery that is spaced radially from the housing interior surface along its entire periphery and said periphery is not fixed to said housing interior surface.

13. The compressor assembly of claim 11, said compression mechanism further including:

said cylinder block including a cylinder aperture, said shaft including an eccentric mounted thereon, said eccentric positioned in said cylinder aperture; and at least one alignment fastener, a portion of said alignment fastener having a thread, said cylinder block having at least one threaded sub-assembly aperture, said bearing having at least one sub-assembly aperture, said at least one alignment fastener passing through said bearing sub-assembly aperture into said cylinder block sub-assembly aperture, said threaded portion of said alignment fastener threadingly engaging said threaded cylinder block sub-assembly aperture, whereby said cylinder block and said bearing can be pressed together.

14. The compressor assembly of claim 11, wherein said muffler peripheral edge is laser-welded to said housing.

15. A compressor assembly, comprising:

a compressor housing having an interior surface defining an interior housing volume; a motor disposed within said housing volume, said motor having a rotatable shaft;

a compressor mechanism drivingly connected to said shaft, said compressor mechanism disposed within said housing volume and including a cylinder block and a main bearing together forming a compression chamber, said bearing rotatably supporting said shaft;

a muffler disposed within said housing volume, said muffler including a housing portion having a peripheral edge abutting the interior surface of said compressor housing in an interference fit relationship, said muffler being supported by said compressor housing, said compressor mechanism main bearing attached to said muffler and supported by said muffler within said compressor housing, said muffler housing portion facing and forming with said main bearing portion a first muffler chamber configured to dissipate acoustic waves, at least one opening in said muffler housing portion fluidly connecting said first chamber with said housing volume; and a discharge port in said main bearing extending from said compression chamber and opening into said first muffler chamber;

said muffler peripheral edge expansively engaging said compressor housing.

16. The compressor assembly of claim 11, further comprising: at least one discharge aperture in said muffler housing portion, said muffler housing portion including a plate having first and second substantially parallel sides, wherein discharge gas compressed by said compressor mechanism is received in said first chamber and exhausted through said at least one discharge aperture, said first chamber and said at least one discharge aperture configured to dissipate sound waves.

17. The compressor assembly of claim 16, said compressor assembly further comprising: a second chamber defined by said first side of said muffler plate and said compressor housing, said second chamber in fluid communication with said first chamber through said at least one discharge aperture; and a third chamber defined by said second side of said muffler plate and said compressor housing, said second chamber and said third chamber in fluid communication through a passage, said second chamber, third chamber and said passage configured to dissipate sound waves.

18. A compressor assembly, comprising:

a compressor housing having an interior surface; a motor disposed within said housing, said motor having a rotatable shaft;

a compressor mechanism drivingly connected to said shaft, said compressor mechanism disposed within said housing and including a cylinder block having a peripheral surface adjacent the housing interior surface and a main bearing together with the cylinder block forming a compression chamber, said bearing rotatably supporting said shaft, said cylinder block peripheral surface not being directly fixed to the housing interior surface;

a muffler disposed within said housing, said muffler including a housing portion having a peripheral edge abutting and connected to the interior surface of said compressor housing, said muffler being supported by said compressor housing, said compressor mechanism main bearing attached to said muffler and supported by said muffler within said compressor housing whereby said cylinder block is also supported by said muffler, said muffler housing portion facing and forming with said main bearing a first muffler chamber configured to dissipate acoustic waves; and a discharge port in said main bearing extending from said compression chamber and opening into said first muffler chamber;

wherein said muffler and said interior surface of said compressor housing define a second chamber and a third chamber, said first chamber and said second chamber in fluid communication through at least one discharge passage, said first chamber, said second chamber and said at least one discharge passage configured to dissipate acoustic waves produced by said compressor mechanism.

19. The compressor assembly of claim 18, including at least one gap intermediate said muffler housing portion and said interior of said compressor housing, said second chamber and said third chamber in fluid communication through said at least one gap, said second chamber, said third chamber and said at least one gap configured to dissipate acoustic waves produced by said compressor mechanism.

20. A compressor assembly, comprising:

a compressor housing having an interior surface; a motor disposed within said housing, said motor having a rotatable shaft;

a compressor mechanism drivingly connected to said shaft, said compressor mechanism disposed within said housing and including a cylinder block having a peripheral surface adjacent the housing interior surface and a main bearing together with the cylinder block forming a compression chamber, said bearing rotatably supporting said shaft, said cylinder block peripheral surface not being directly fixed to the housing interior surface;

a muffler disposed within said housing, said muffler including a housing portion having a peripheral edge abutting and connected to the interior surface of said compressor housing, said muffler being supported by said compressor housing, said compressor mechanism main bearing attached to said muffler and supported by said muffler within said compressor housing whereby said cylinder block is also supported by said muffler, said muffler housing portion facing and forming with said main bearing a first muffler chamber configured to dissipate acoustic waves; and a discharge port in said main bearing extending from said compression chamber and opening into said first muffler chamber;

said peripheral edge of said muffler housing portion defined by at least three protrusions extending from said muffler housing portion, said at least three protrusions abutting the interior of said compressor housing to resiliently expand said compressor housing, at least one gap between the muffler housing portion and the compressor housing interior being positioned intermediate the three protrusions.

21. A compressor assembly, comprising:

a compressor housing having an interior surface; a motor disposed within said housing, said motor having a rotatable shaft;

a compressor mechanism drivingly connected to said shaft, said compressor mechanism disposed within said housing and including a cylinder block and a main bearing together forming a compression chamber, said bearing rotatably supporting said shaft;

a muffler disposed within said housing, said muffler including a housing portion having a peripheral edge abutting and connected to the interior surface of said compressor housing, said muffler being supported by said compressor housing, said compressor mechanism main bearing attached to said muffler and supported by said muffler within said compressor housing whereby said cylinder block is also supported by said muffler, said muffler housing portion facing and forming with said main bearing a first muffler chamber configured to dissipate acoustic waves; and a discharge port in said main bearing extending from said compression chamber and opening into said first muffler chamber;

said motor in an interference fit relationship with said compressor housing, said compressor mechanism and said motor aligned by said compressor housing and said muffler housing portion, said shaft operatively aligned with said compressor mechanism and said motor.

22. The compressor assembly of claim 12, said compression mechanism further including:

said cylinder block including a cylinder aperture, said shaft including an eccentric mounted thereon, said eccentric positioned in said cylinder aperture; and at least one alignment fastener, a portion of said alignment fastener having a thread, said cylinder block having at least one threaded sub-assembly aperture, said bearing having at least one sub-assembly aperture, said at least one alignment fastener passing through said bearing sub-assembly aperture into said cylinder block sub-assembly aperture, said threaded portion of said alignment fastener threadingly engaging said threaded cylinder block sub-assembly aperture, whereby said cylinder block and said bearing can be pressed together.

23. The compressor assembly of claim 12, wherein said muffler peripheral edge is laser-welded to said housing.

* * * * *